US011730667B2

(12) United States Patent
Yang et al.

(10) Patent No.: US 11,730,667 B2
(45) Date of Patent: Aug. 22, 2023

(54) WEARABLE STIMULATION DEVICE FOR STIMULATING DEEP MUSCLES OF ABDOMEN AND WAIST OF HUMAN BODY

(71) Applicant: TZU CHI UNIVERSITY, Hualien (TW)

(72) Inventors: Chich-Haung Yang, Hualien (TW); Ya-Hui Chang, Hualien (TW); Yu-Ming Chang, Hualien (TW); Cheng-Chun Cheng, Hualien (TW)

(73) Assignee: Tzu Chi University, Hualien County (TW)

( * ) Notice: Subject to any disclaimer, the term of this patent is extended or adjusted under 35 U.S.C. 154(b) by 175 days.

(21) Appl. No.: 17/314,504

(22) Filed: May 7, 2021

(65) Prior Publication Data

US 2022/0354737 A1 Nov. 10, 2022

(51) Int. Cl.
*A61H 23/00* (2006.01)
*A61H 23/02* (2006.01)

(52) U.S. Cl.
CPC . *A61H 23/0236* (2013.01); *A61H 2023/0209* (2013.01); *A61H 2201/163* (2013.01); *A61H 2201/165* (2013.01); *A61H 2201/5092* (2013.01); *A61H 2205/088* (2013.01)

(58) Field of Classification Search
CPC ..... A61H 23/0236; A61H 2023/0209; A61H 2201/163; A61H 2201/165; A61H 2201/5092; A61H 2205/088
See application file for complete search history.

(56) References Cited

U.S. PATENT DOCUMENTS

| | | | | |
|---|---|---|---|---|
| 9,526,946 | B1 | 12/2016 | Zets et al. | |
| 2008/0077192 | A1* | 3/2008 | Harry | A61N 1/0476 42/84 |
| 2016/0140866 | A1* | 5/2016 | McGuire | A61B 5/6804 434/247 |
| 2019/0290537 | A1* | 9/2019 | Engles | A61H 23/0236 |
| 2020/0121544 | A1* | 4/2020 | George | A61H 9/00 |

FOREIGN PATENT DOCUMENTS

| | | | |
|---|---|---|---|
| CN | 105555245 | A | 5/2016 |
| CN | 110051536 | A | 7/2019 |
| TW | 201626953 | A | 8/2016 |
| TW | M550157 | U | 10/2017 |

* cited by examiner

*Primary Examiner* — Philip R Wiest
*Assistant Examiner* — Sarah B Lederer
(74) *Attorney, Agent, or Firm* — Rosenberg, Klein & Lee

(57) ABSTRACT

A wearable stimulation device includes a wearable member, a stimulation unit, and a driver. The stimulation unit is secured to the wearable member. The stimulation unit includes an immovable end, a stimulation end, and a power element. The power element is connected between the immovable end and the stimulation end for driving the stimulation end to reciprocate relative to the immovable end. The driver is in signal connection with the power element. The driver is configured to output a vibration signal to the power element for the stimulation end to have a stroke of between 8.8 mm and 10.8 mm, a thrust of between 5.6 N and 7.6 N and a reciprocating frequency of between 180 Hz and 220 Hz, thereby stimulating the deep muscles of the abdomen or waist of a human body without affecting the superficial muscles.

8 Claims, 14 Drawing Sheets

WEARABLE STIMULATION DEVICE FOR STIMULATING DEEP MUSCLES OF ABDOMEN AND WAIST OF HUMAN BODY

FIELD OF THE INVENTION

The present invention relates to a wearable stimulation device, and more particularly to an active wearable stimulation device for stimulating the deep muscles of the abdomen and waist of a human body, which can strengthen the deep muscles of the abdomen and waist and increase the motion control ability of the abdomen and waist.

BACKGROUND OF THE INVENTION

There are some devices that can stimulate the muscles of the abdomen or waist of a human body on the market, for example, U.S. Patent Application Publication No. US20160140866, titled "TACTILE INPUT FOR IMPROVING PHYSICAL MOVEMENT". A system for providing tactile input for prompting a person to coordinate appropriate muscle contractions during some form of physical movement such as exercising. The system may comprise a belt bearing inwardly facing projections adapted to make contact with a user's skin. The user may then be prompted by sensory tactile feedback or by audible, visible, or vibratory outputs to facilitate proper contractions. In operation, when the user produces muscle expansion during exercise, the muscle expansion will exert a predetermined pressure to the projections. After the projections receive the pressure, it outputs a pressure signal through a transducer to obtain the user's specific muscle status. Then, according to the pressure signal, prompts such as sound, light or vibration are generated to prevent the user's improper posture from causing muscle damage. However, the projections are used to receive the pressure exerted by the muscles and are not used to provide active stimulation to the user's muscles.

U.S. Pat. No. 9,526,946 discloses a system and a method for providing therapy and assessment utilizing vibrotactile feedback. Such treatment is useful for the treatment of disequilibrium and balance disorders. The system includes a vibrotactile belt to be worn around the waist of a user. The vibrotactile belt includes a plurality of actuators arranged at intervals. The actuators work together to stimulate a tactile response through the skin. Through tactile perception, the user can be guided to move or exercise in the correct posture. The actuators stimulate the user through different changes in pulse and time for prompting the user to exercise in the correct posture. Although the actuators are worn on the waist of the user, they only provide tactile warnings through vibrations and are not used to stimulate the user's deep muscles. Besides, the actuators are used for frequency and time control only, without control parameters such as movement stroke, thrust, and reciprocating frequency.

Taiwan Utility Model Publication No. M550157, titled "LOW FREQUENCY INFRASONIC THERAPY DEVICE" published on Oct. 11, 2017, comprises a host and an infrasonic wave booster. The host has an infrasonic wave frequency generator for generating at least one frequency signal of infrasonic wave frequency. The infrasonic wave booster is electrically connected to the host and configured to receive the frequency signal transmitted by the host to emit the infrasonic wave of the frequency. The infrasound waves generated by the therapy device are energy waves and vibration waves in the form of sine waves. The frequency range is adjustable according to different body parts and purposes of use. If a deeper or wider range of use is needed, a lower frequency is outputted. If a superficial and concentrated range of use is needed, a higher frequency is outputted. With the wave energy of the low-frequency infrasonic waves, the therapy device can provide soothing and regulating functions to the human body, and can provide superficial and deep induction to the human body. However, through low-frequency infrasonic waves to induce superficial and deep muscles, this way cannot stimulate deep muscles.

Taiwan Patent Publication No. 201626953, titled "WAIST VIBRATION SIGNAL GENERATOR" published on Aug. 1, 2016, comprises a main body, a vertical vibration signal generator, a control unit, a power supply unit, and a hanging unit. The main body has a first axis. The vertical vibration signal generator is arranged inside the main body. The vertical vibration signal generator includes a voice coil motor and a flexible film that are arranged along the first axis. The voice coil motor includes a permanent magnet, a coil and a pair of coil connecting wires. When the control unit supplies a direct current to the pair of coil connecting wires, the coil generates a magnetic field for the permanent magnet to move along the first axis. The movement of the permanent magnet causes different voltage changes of the coil connecting wires, and the permanent magnet generates a pushing and moving force on the flexible film. For those who need to contract the abdomen from time to time to keep the body in shape, when the lower abdomen is protruding for a while, the protruding lower abdomen will push the flexible film. At this time, the pressure detection module can detect the pressure of the flexible film through the pair of coil connecting wires and send the pressure value to the central control module. When the central control module captures the pressure value and determines that the pressure value is greater than the pushing threshold value for a period of a working time, it controls the vertical vibration signal generator to generate a warning pressing rhythm along the first axis. The voice coil motor is used to control the permanent magnet to drive the flexible film to correspond to the human body for repeatedly pushing and contracting and generating a vibration rhythm perpendicular to the waist skin direction. The pressure detection module senses the reverse pressure change of the permanent magnet through the flexible film when the lower abdomen is protruding. When the pressure is greater than the pushing threshold for a period of working time, the pushing rhythm can be changed to the human body. This patent does not use the voice coil motor to stimulate deep muscles, and it does not disclose control parameters such as movement stroke, thrust, and reciprocating frequency, so it is obviously different from the technical features of the present invention.

SUMMARY OF THE INVENTION

In view of the above-mentioned shortcomings of the conventional abdominal and waist stimulation devices, the present invention provides a wearable stimulation device for stimulating the deep muscles of the abdomen and waist of a human body. The wearable stimulation device comprises a wearable member, at least one stimulation unit, and at least one driver. The stimulation unit is secured to the wearable member. The stimulation unit includes an immovable end, a stimulation end, and a power element. The power element is connected between the immovable end and the stimulation end for driving the stimulation end to reciprocate relative to the immovable end. The driver is in signal connection with the power element. The driver is configured to output a vibration signal to the power element for the stimulation end to have a stroke of between 8.8 mm and 10.8 mm, a thrust of between 5.6 N and 7.6 N and a reciprocating frequency of between 180 Hz and 220 Hz.

The wearable stimulation device further comprises a noise generator. The noise generator is in signal connection with the driver. The noise generator is configured to output a noise signal. The noise signal is combined with the vibration signal to be simultaneously output to the power element.

Preferably, the noise generator has a noise control interface for outputting the noise signal. The noise signal is a Gaussian signal.

Preferably, the immovable end has a disc shape. A periphery of the immovable end is provided with a plurality of immovable blocks. Each of the immovable blocks is provided with a slide rail. The stimulation end has a disc shape. A periphery of the stimulation end is provided with a plurality of movable blocks. The movable blocks are insertedly disposed on the slide rails of the immovable blocks to slide on the slide rails.

Preferably, the wearable stimulation device further comprises an optical scale unit. The optical scale unit includes a detector and a scale. The detector is fixed to any one of the immovable blocks. The scale is fixed to a corresponding one of the movable blocks. The detector is configured to detect a displacement distance of the scale to obtain a movement distance of the stimulation end relative to the immovable end.

Preferably, the stimulation end has an action surface, and at least one stimulation protrusion is provided on the action surface.

Preferably, the power element is a voice coil motor. The voice coil motor includes a coil part and a magnet part. The coil part is fixed to the immovable end. The magnet part is fixed to the stimulation end. After the coil part is energized, a magnetic field is generated. The magnet part interacts with the magnetic field, so that the magnet part generates a reciprocating motion relative to the coil part.

Preferably, the vibration signal is a sine wave signal.

Preferably, the stroke of the stimulation end is 9.8 mm, the thrust of the stimulation end is 6.6 N, and the reciprocating frequency of the stimulation end is 200 Hz.

Preferably, the wearable member is a waist belt to be worn around the abdomen or waist of the human body, so that the stimulation unit corresponds in position to the transverse abdominis (TrA) and the multifidus muscle of the human body.

The above technical features have the following advantages:

1. It can effectively acts on the deep muscles of the abdomen or waist of a human body to increase activation of the deep muscles.

2. It does not make the superficial muscles of the waist stimulation area stiff, such as the rectus abdominis (RA), the external oblique muscle (EO) and the erector spinae (ES).

3. It can strengthen the deep muscles of the abdomen and waist to increase the control ability of the abdomen and waist.

DESCRIPTION OF THE PREFERRED EMBODIMENTS

Embodiments of the present invention will now be described, by way of example only, with reference to the accompanying drawings.

Figure 1:
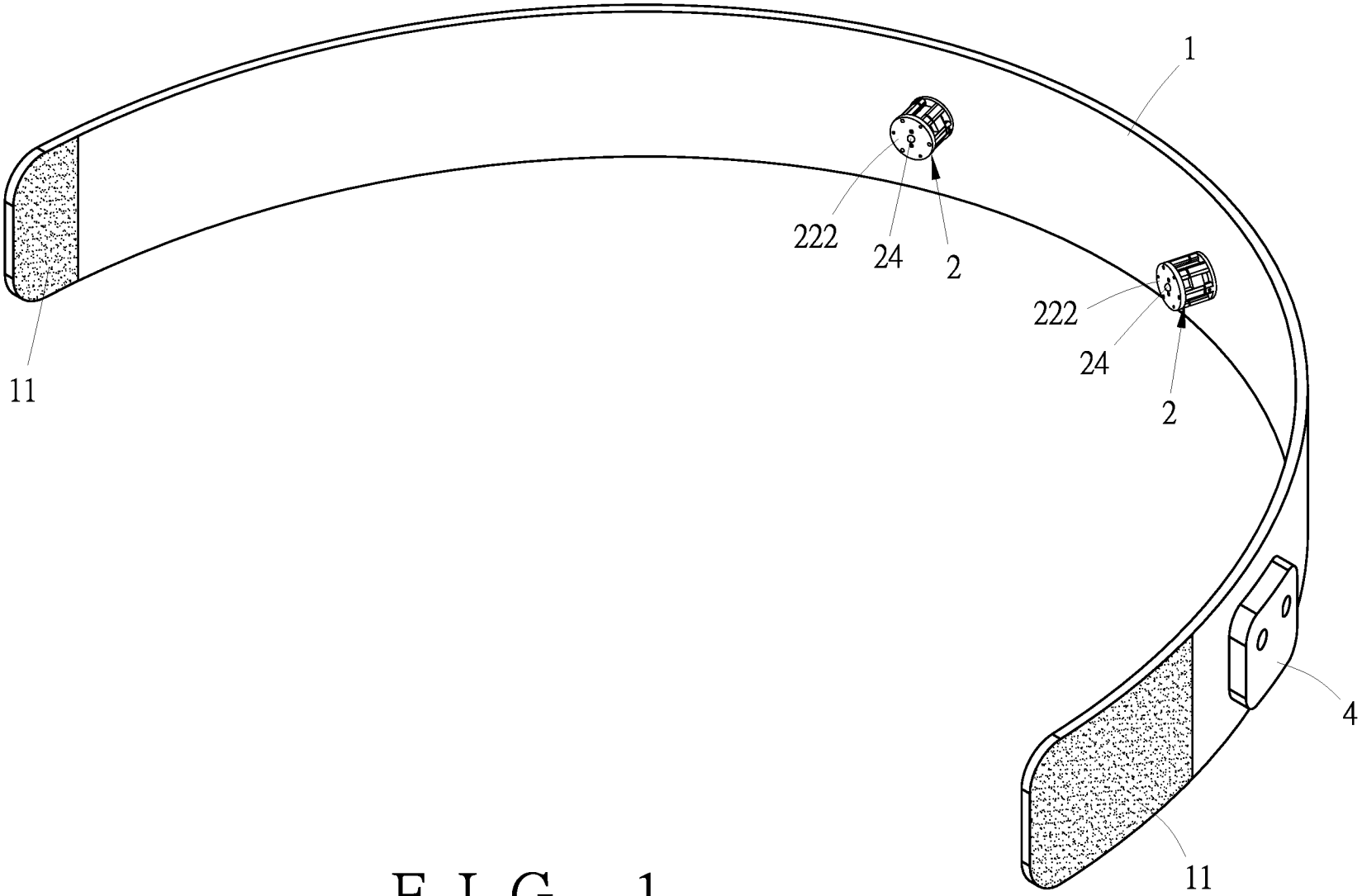
FIG. 1 is a perspective view according to a preferred embodiment of the present invention.
Figure 2:
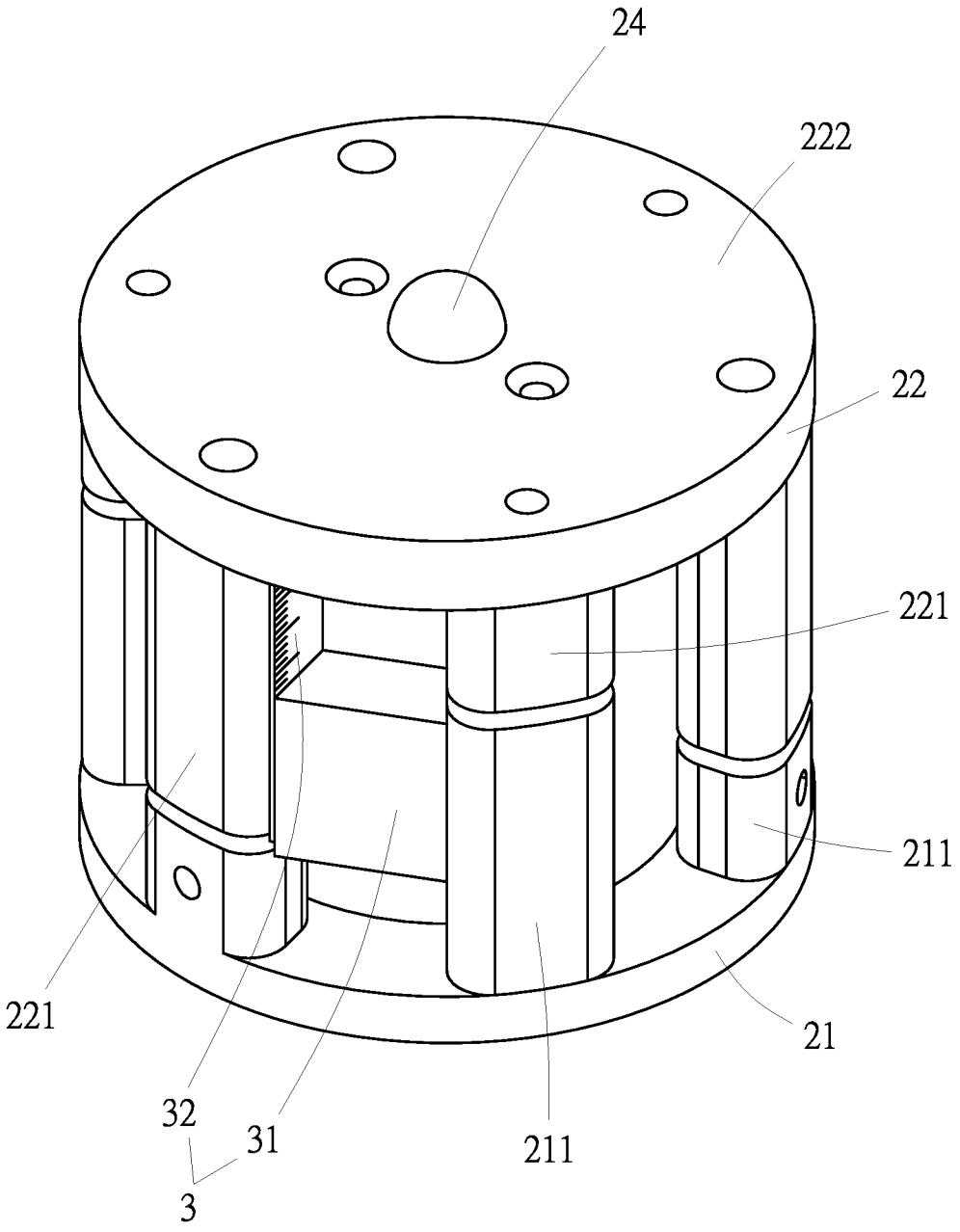
FIG. 2 is a perspective view of the stimulation unit according to the preferred embodiment of the present invention.

As shown in FIG. 1 and FIG. 2, a wearable stimulation device for stimulating the deep muscles of the abdomen and waist of a human body according to an embodiment of the present invention comprises a wearable member (1), at least one stimulation unit (2), an optical scale unit (3), at least one driver (4), and a noise generator (5).

The wearable member (1) may be a waist belt to be worn around the abdomen or waist of a human body. Two ends of the wearable member (1) are respectively provided with hook-and-loop fasteners (11) to be attached to each other, so that the wearable member (1) can be secured around the abdomen or waist of the human body.

Figure 3:
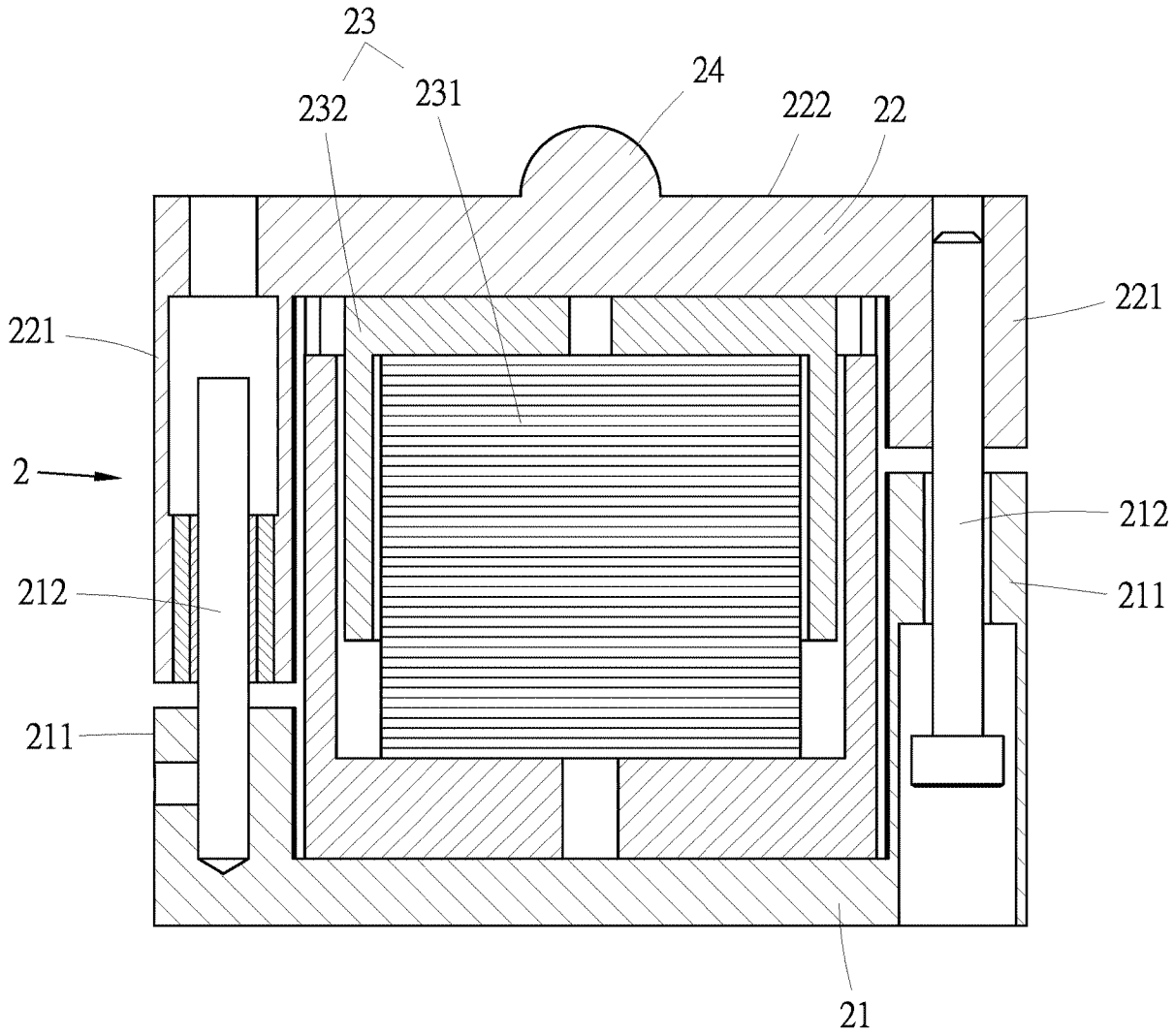
FIG. 3 is a cross-sectional view of the stimulation unit according to the preferred embodiment of the present invention.
Figure 4:
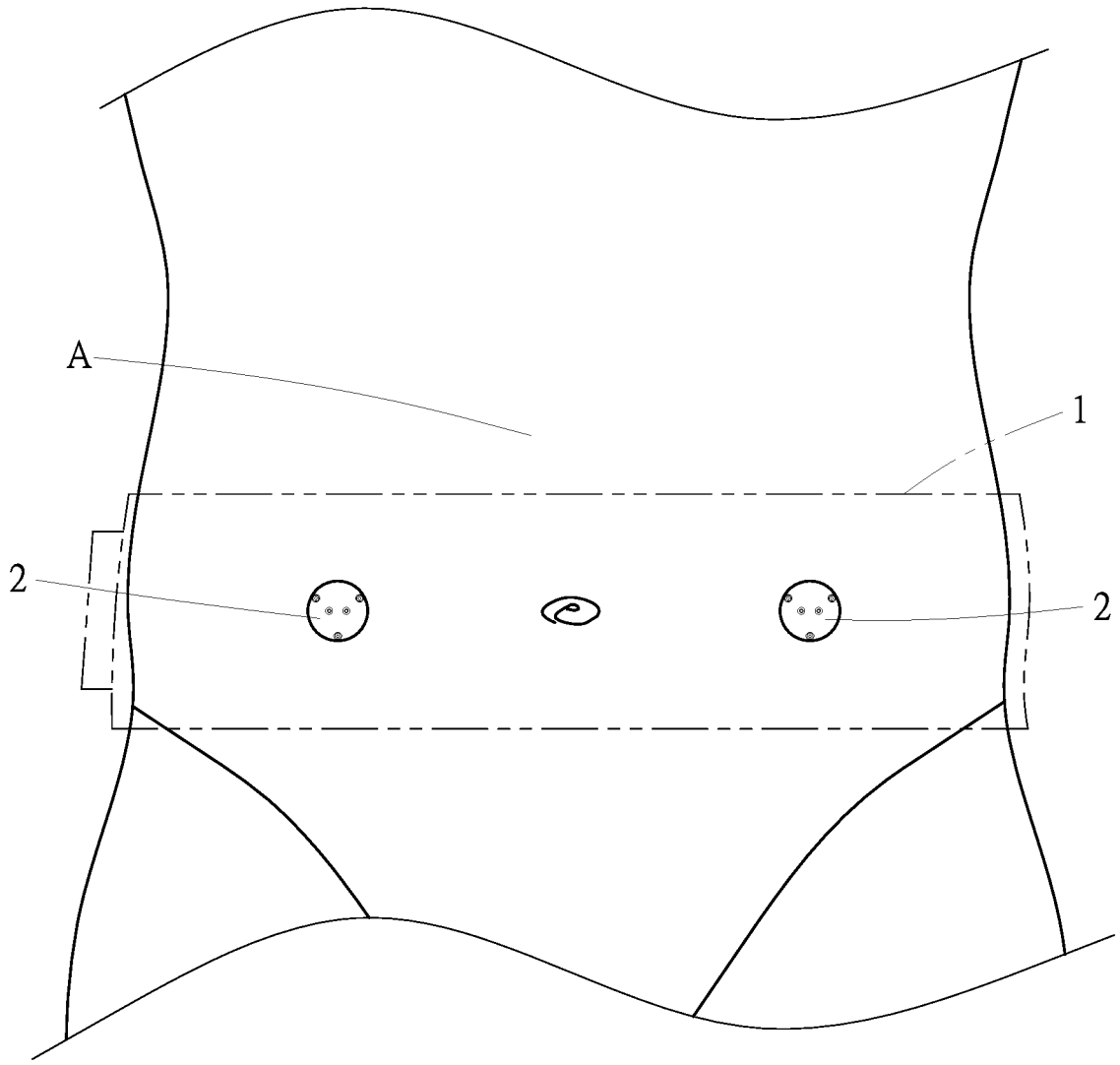
FIG. 4 is a schematic view according to the preferred embodiment of the present invention applied to the abdomen of a human body.
Figure 5:
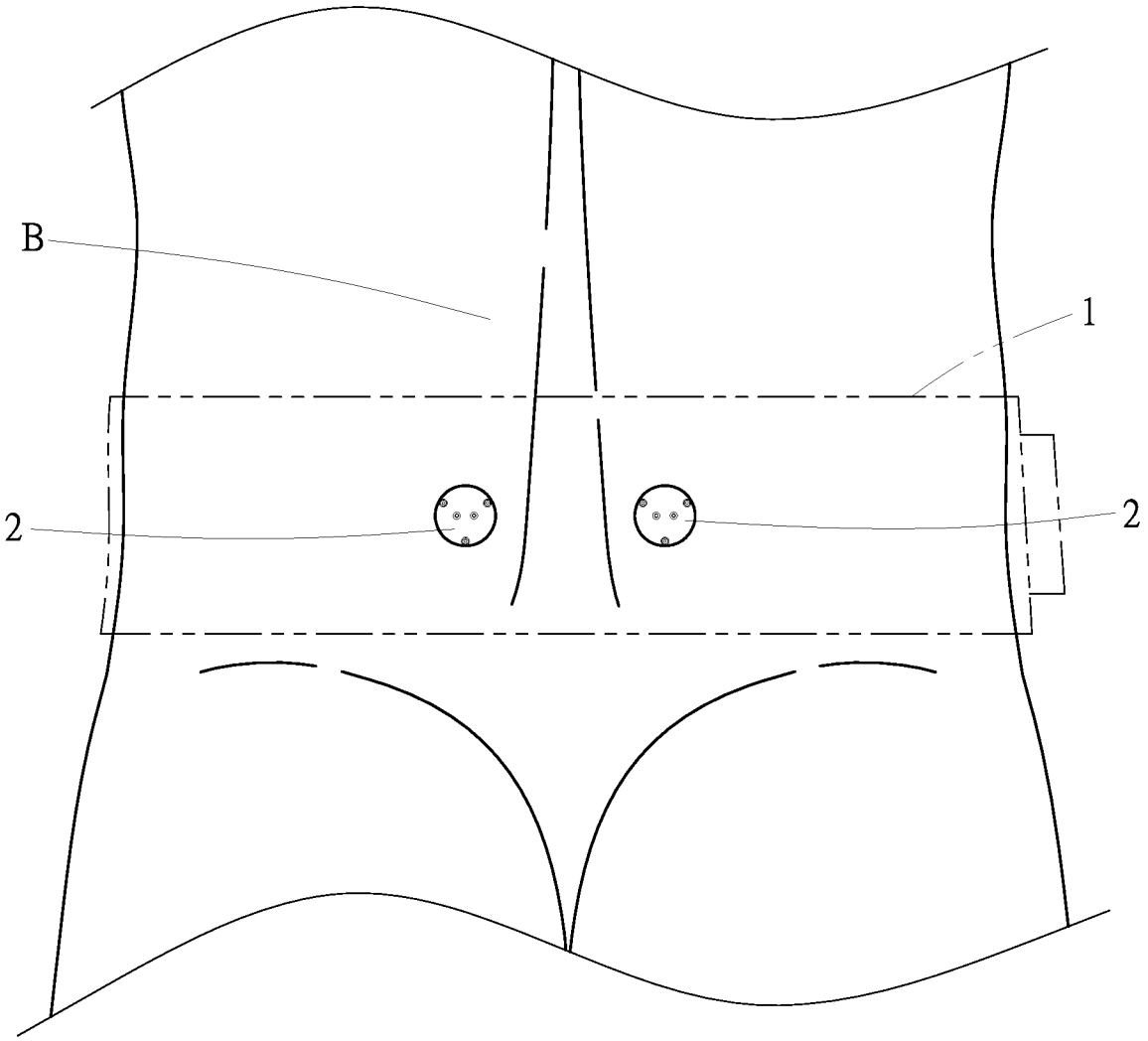
FIG. 5 is a schematic view according to the preferred embodiment of the present invention applied to the waist of a human body.

The stimulation unit (2) is secured to the wearable member (1). As shown in FIG. 3, the stimulation unit (2) includes an immovable end (21), a stimulation end (22), a power element, and at least one stimulation protrusion (24). The power element may be a voice coil motor (23). The voice coil motor (23) is connected between the immovable end (21) and the stimulation end (22) for driving the stimulation end (22) to reciprocate relative to the immovable end (21). The immovable end (21) has a disc shape. The periphery of the immovable end (21) is provided with a plurality of immovable blocks (211). Each of the immovable blocks (211) is provided with a slide rail (212). The stimulation end (22) is movable relative to the immovable end (21). The stimulation end (22) has a disc shape. The periphery of the stimulation end (22) is provided with a plurality of movable blocks (221). The movable blocks (221) are insertedly disposed on the slide rails (212) of the immovable blocks (211) to slide back and forth on the slide rails (212). The stimulation end (22) has an action surface (222). The action surface (222) faces away from the immovable end (21). The voice coil motor (23) includes a coil part (231) and a magnet part (232). The coil part (231) is fixed to the immovable end (21). The magnet part (232) is fixed to the stimulation end (22). After the coil part (231) is energized, a magnetic field is generated. The magnet part (232) interacts with the magnetic field, so that the magnet part (232) generates a regular reciprocating motion relative to the coil part (231). The movable blocks (221) of the stimulation end (22) are driven to slide on the slide rails (212), so that the stimulation end (22) reciprocates relative to the immovable end (21). The stimulation protrusion (24) is arranged on the action surface (222) of the stimulation end (22), so as to stimulate the deep muscles of the abdomen or waist of the human body. The stimulation protrusion (24) has a conical shape. In this embodiment of the present invention, two spaced stimulation units (2) are secured to the wearable member (1). The interval between the two stimulation units (2) may be different according to the stimulation position of the abdomen or waist of the human body. As shown in FIG. 4, for the position of the deep muscles (transverse abdominis) of the abdomen (A) of the human body, the interval between the two stimulation units (2) may be set to be wider. As shown in FIG. 5, for the position of the deep muscles (multifidus muscle) of the waist (B) of the human body, the interval between the two stimulation units (2) is set to be narrow.

The optical scale unit (3) includes a detector (31) and a scale (32). The detector (31) is fixed to any one of the immovable blocks (211) of the immovable end (21). The scale (32) is fixed to a corresponding one of the movable blocks (221) of the stimulation end (22). The detector (31) is configured to detect the displacement distance of the scale (32) to obtain the movement distance of the stimulation end (22) relative to the immovable end (21).

Figure 6:
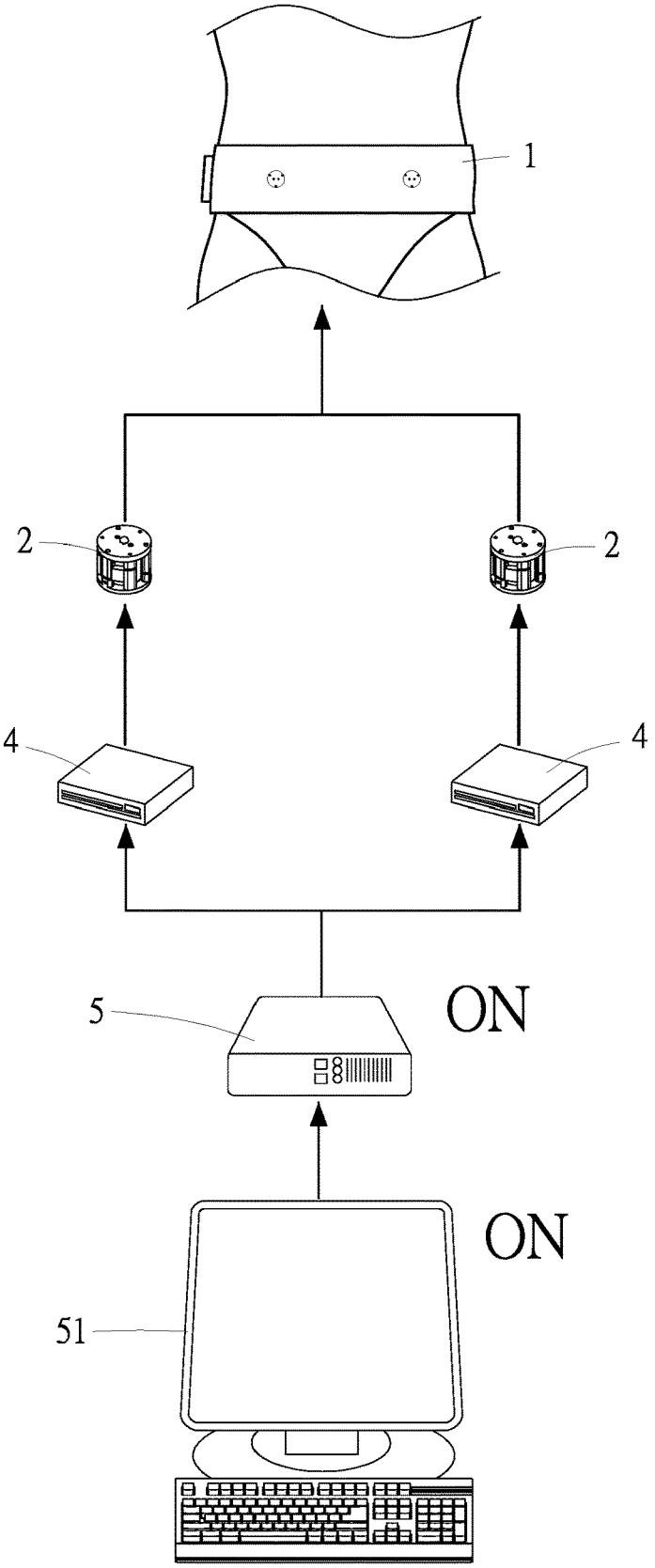
FIG. 6 is a schematic view of signal transmission in a combined vibration and noise mode according to the preferred embodiment of the present invention.

As shown in FIG. 6, this embodiment of the present invention includes two drivers (4) corresponding to the two stimulation units (2). The two drivers (4) are fixed to the wearable member (1) and are in signal connection with the two voice coil motors (23) of the two stimulation units (2) for outputting a vibration signal to the two voice coil motors (23), respectively. The vibration signal is a sine wave signal. The vibration signal enables the voice coil motor (23) to be energized, so that the stroke of the stimulation end (22) is between 8.8 mm and 10.8 mm. The best stroke is 9.8 mm. The thrust of the stimulation end (22) is between 5.6 N and 7.6 N. The best thrust is 6.6 N. The reciprocating frequency of the stimulation end (22) is between 180 Hz and 220 Hz. The best reciprocating frequency is 200 Hz.

The noise generator (5) is in signal connection with the two drivers (4) through a wired or wireless means. The noise generator (5) outputs a noise signal to the two voice coil motors (23) through the two drivers (4). The noise signal is a Gaussian signal. The noise generator (5) has a noise control interface (51). The noise control interface (51) may be a computer or a smart phone, so that the noise signal can be output through the noise control interface (51).

When in use, as shown in FIG. 1 and FIG. 3, an appropriate wearable member (1) is selected according to the deep muscles of the user's body part to be stimulated. The wearable member (1) is worn around the user's abdomen or waist, so that the two stimulation units (2) are positioned and correspond in position to the user's abdomen (as shown in FIG. 4) or waist (as shown in FIG. 5).

Figure 7:
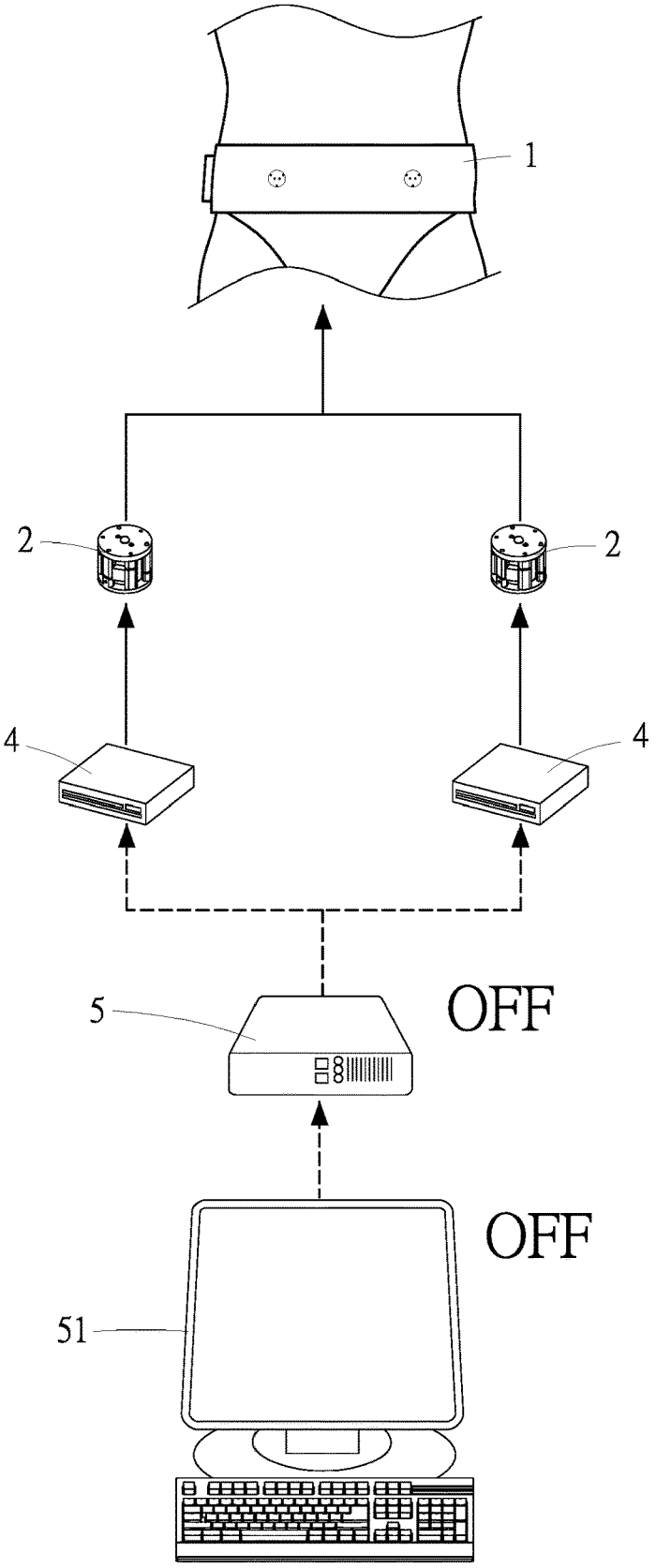
FIG. 7 is a schematic view of signal transmission in a single vibration mode according to the preferred embodiment of the present invention.

In the beginning, the user can select a single vibration mode or a combined vibration and noise mode. If a single vibration mode is selected, as shown in FIG. 7, only the two drivers (4) need to be activated, so as to energize the two voice coil motors (23) respectively and to output the vibration signal. The coil part (231) will generate a magnetic field after being energized, and the magnet part (232) will generate an interaction in the magnetic field, so that the magnet part (232) generates a regular reciprocating motion relative to the coil part (231), and the stroke of the stimulation end (22) is between 8.8 mm and 10.8 mm. In this way, the movable blocks (221) of the stimulation end (22) can be driven to slide on the slide rails (212), and the reciprocating frequency of the stimulation end (22) is between 180 Hz and 220 Hz. The thrust of the stimulation end (22) is between 5.6 N and 7.6 N, so that the stimulation protrusions (24) on the action surface (222) can respectively stimulate the deep muscles of the user's abdomen or waist. The stimulation protrusion (24) is in a conical shape, so that it has a small contact area with the waist of the human body to apply greater pressure. In this way, all the muscles under the skin of the abdomen or waist can be contracted together. The deep muscles that are responsible for stability include the transverse abdominis (TrA) of the abdomen and the multifidus (MF) muscle of the waist, which can increase the activation of deep muscles of the abdomen or waist. Besides, there is no significant effect on the superficial muscles of the abdomen or waist (such as the rectus abdominis (RA), the external oblique muscle (EO) and the erector spinae (ES)).

When the combined vibration and noise mode is selected for use, as shown in FIG. 6, the two drivers (4) need to be activated to respectively energize the two voice coil motors (23) and output the vibration signal, and the noise generator (5) is activated through the noise control interface (51), so that the noise generator (5) outputs a noise signal to the two voice coil motors (23) through the respective two drivers (4). The noise signal is combined with the vibration signal to be output simultaneously, so that the magnet part (232) generates a regular reciprocating motion relative to the coil part (231). The stroke of the stimulation end (22) is between 8.8 mm and 10.8 mm. The reciprocating frequency of the stimulation end (22) is between 180 Hz and 220 Hz. The thrust of the stimulation end (22) is between 5.6 N and 7.6 N. In this way, the stimulation protrusions (24) on the action surface (222) each can produce a strengthened stimulation effect on the deep muscles of the user's abdomen or waist, so that all muscles under the skin of the abdomen or waist can contract together. For the transverse abdominis (TrA) of the abdomen and the multifidus (MF) muscle of the waist, deep activation can be increased. Besides, there is no significant effect on the superficial muscles of the abdomen or waist (such as the rectus abdominis (RA), the external oblique muscle (EO) and the erector spinae (ES)).

Through the actual testing for the present invention, two groups of people are selected for testing. The ages are 13-16 years old. The height, weight, age, and gender of the group members are similar to each other, and each group has 6 males and 6 females. One group is the healthy swimming group (hereinafter referred to as the SWIM group), and the conditions for participation are swimming 10 to 11 times a week for 90 minutes each time. The other group is the healthy control group (hereinafter referred to as the HC group), and the conditions for participation are no more than 3 times a week or no more than 30 minutes each time. The test items include three test modes for the transverse abdominis (TrA) of the abdomen and the multifidus (MF) muscle of the waist of the two group members. The first test mode does not give any stimulation (the following test code is N). The second test mode is performed in a single vibration mode (the following test code is V). The third test mode is performed in a combined vibration and noise mode (the following test code is S). The results after the test are as follows.

Figure 8:
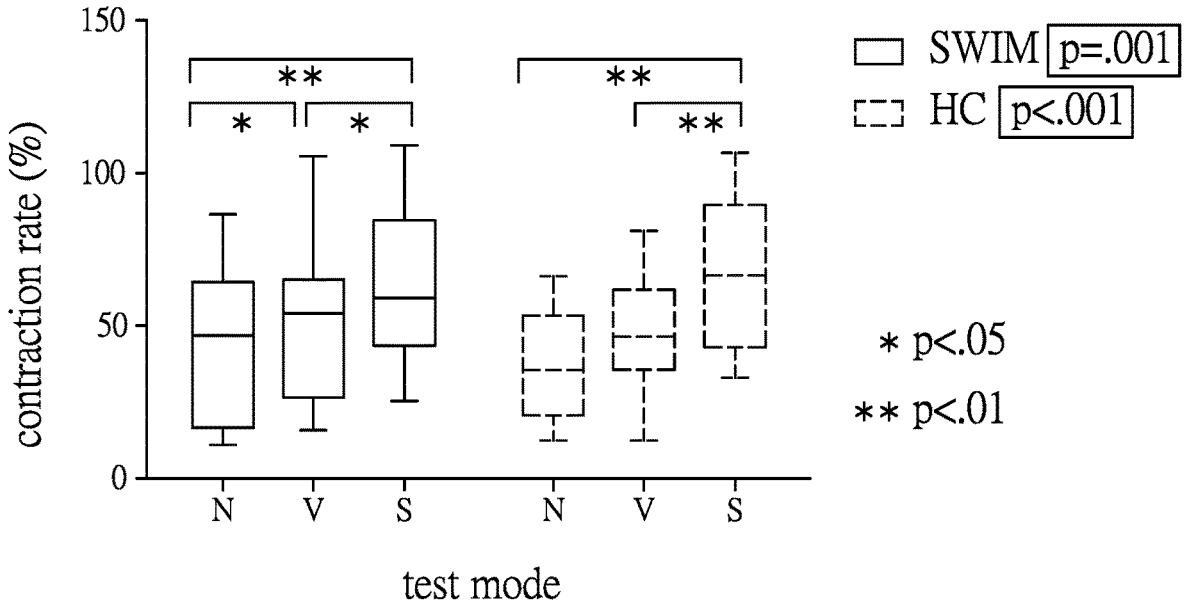
FIG. 8 is a box plot and line graph, illustrating the thickness change in muscle contraction of the transverse abdominis (TrA) according to the preferred embodiment of the present invention.
Figure 8:
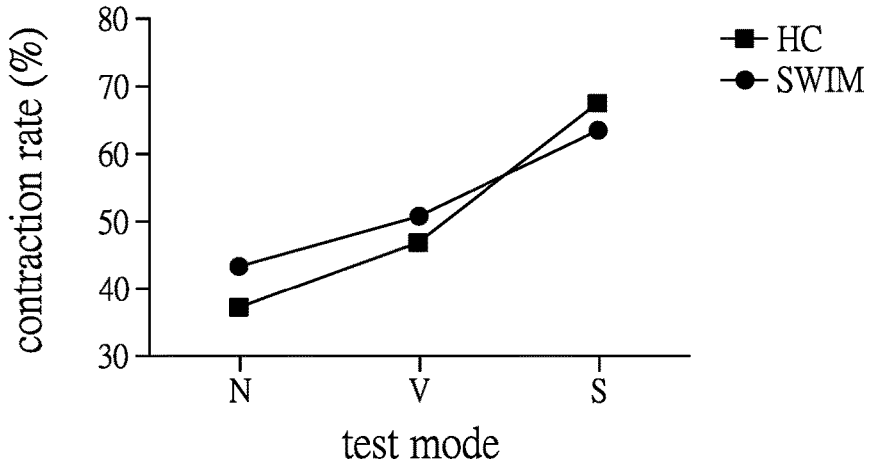

FIG. 8 is a box plot and line graph, illustrating the thickness change in muscle contraction of the transverse abdominis (TrA) of the deep muscles through ultrasound scan (USD) after the SWIM group (solid line) and the HC group (dashed line) are tested in the three different test modes, N, V, and S. The calculation formula of the contraction rate (%) of the muscles is (ADIM-rest)/rest. Wherein, ADIM: contraction, rest: rest.

Figure 9:
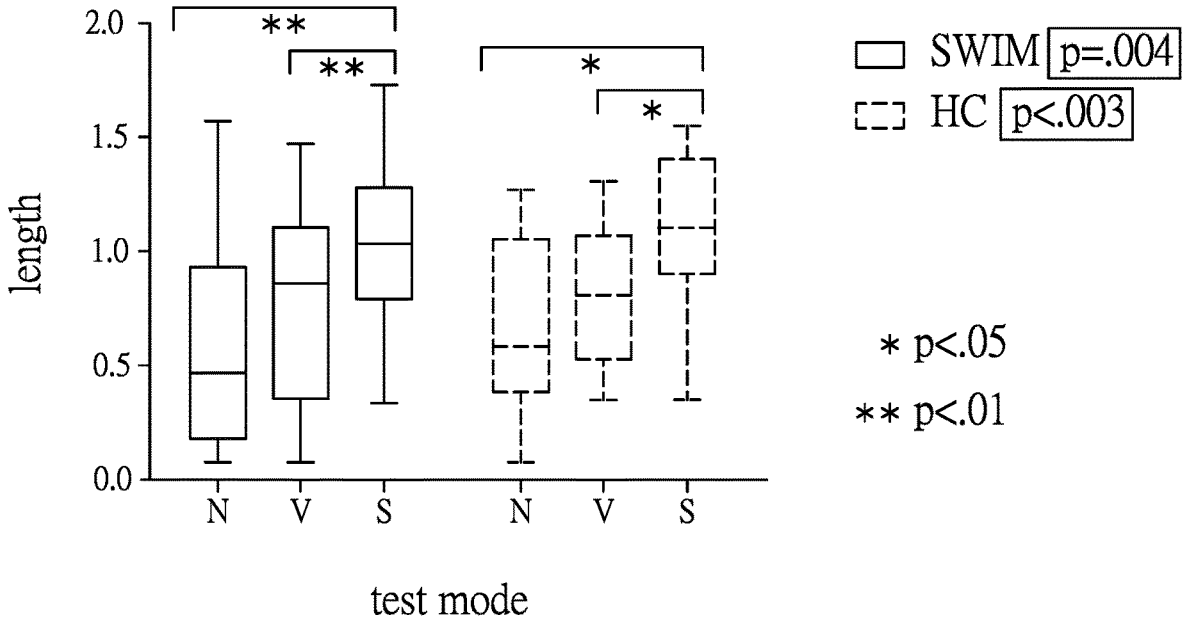
FIG. 9 is a box plot and line graph, illustrating the length change in muscle contraction of the transverse abdominis (TrA) according to the preferred embodiment of the present invention.
Figure 9:
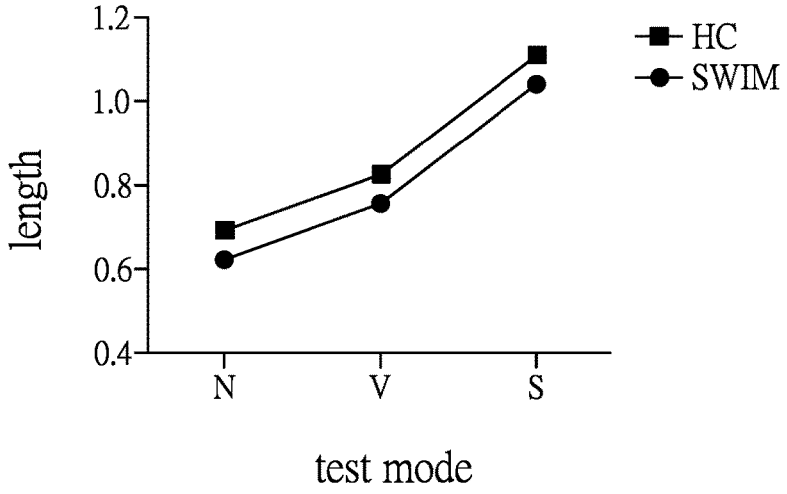

FIG. 9 is a box plot and line graph, illustrating the length change in muscle contraction of the transverse abdominis (TrA) through ultrasound scan (USD) after the SWIM group (solid line) and the HC group (dashed line) are tested in the three different test modes, N, V, and S.

As shown in FIG. 8 and FIG. 9, when the transverse abdominis (TrA) is contracted, its thickness increases and its length decreases. After being tested in the S mode, the increase in muscle activation is significantly better than that of the V mode, and the V mode is better than the N mode.

Figure 10:
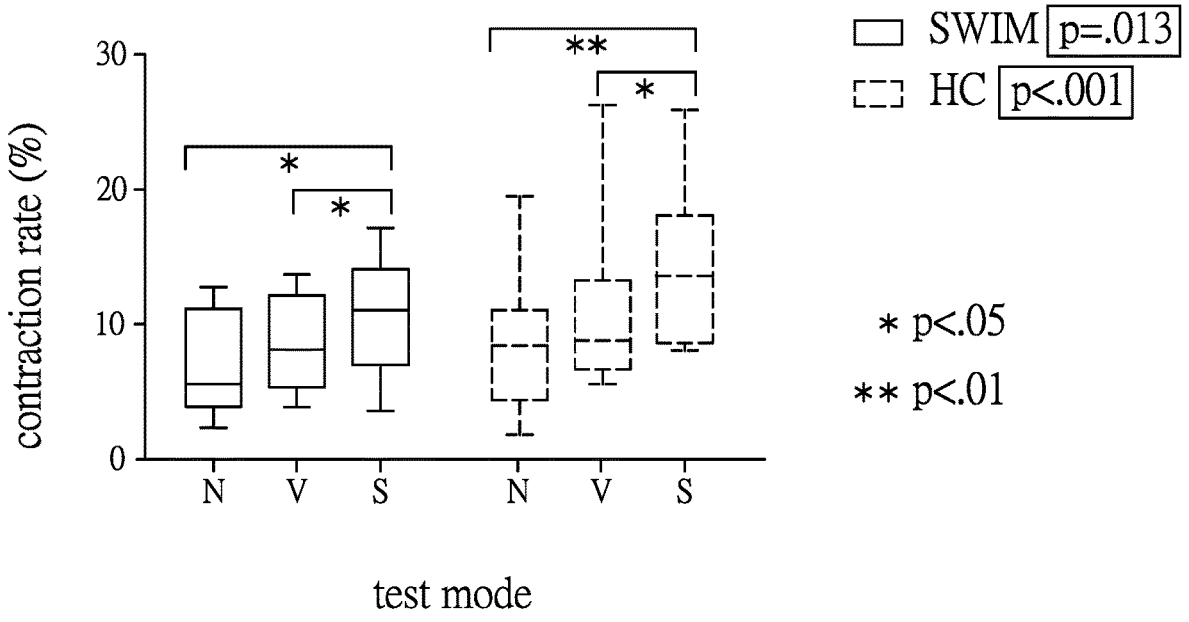
FIG. 10 is a box plot and line graph, illustrating the thickness change in muscle contraction of the multifidus muscle (MF) according to the preferred embodiment of the present invention.
Figure 10:
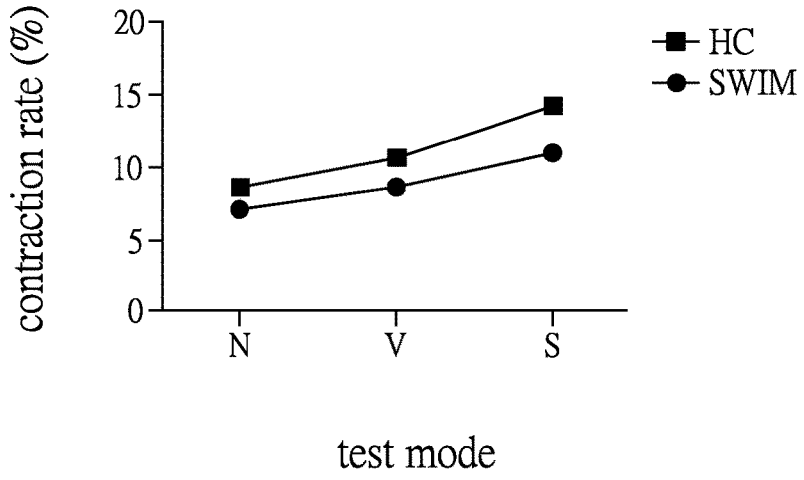

FIG. 10 is a box plot and line graph, illustrating the thickness change in muscle contraction of the multifidus muscle (MF) of the deep muscles through ultrasound scan (USD) after the SWIM group (solid line) and the HC group (dashed line) are tested in the three different test modes, N, V, and S.

Figure 11:
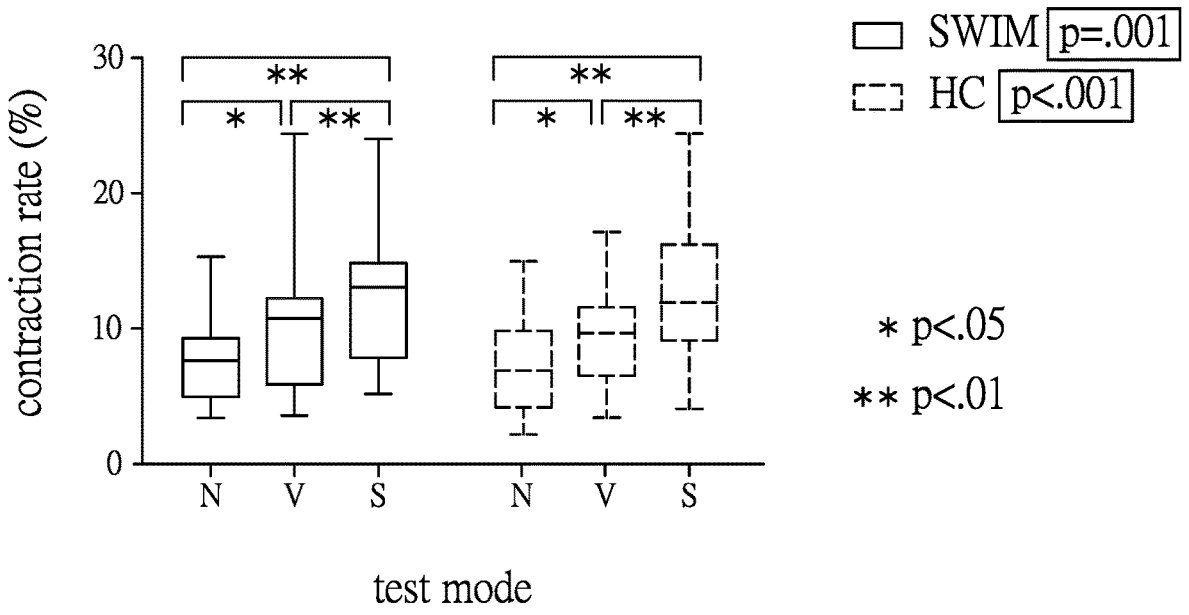
FIG. 11 is a box plot and line graph, illustrating the sectional area change in muscle contraction of the multifidus muscle (MF) according to the preferred embodiment of the present invention.
Figure 11:
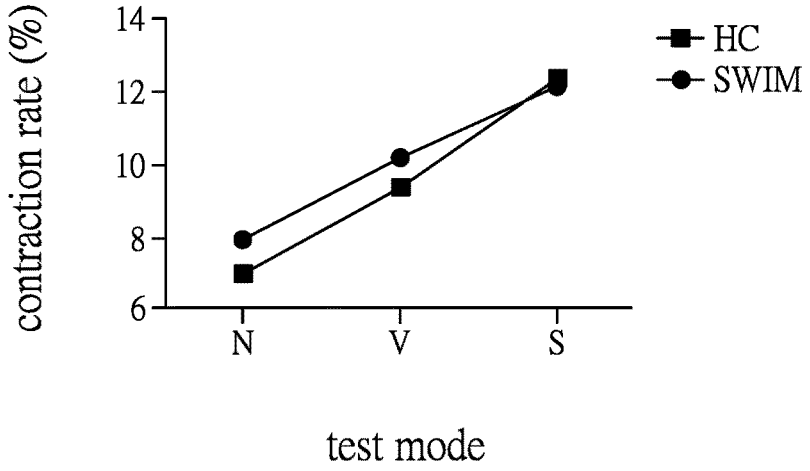

FIG. 11 is a box plot and line graph, illustrating the sectional area change in muscle contraction of the multifidus muscle (MF) through ultrasound scan (USD) after the SWIM group (solid line) and the HC group (dashed line) are tested in the three different test modes, N, V, and S.

As shown in FIG. 10 and FIG. 11, when the multifidus muscle (MF) is contracted, its thickness increases and its sectional area decreases. After being tested in the S mode, the increase in muscle activation is significantly better than that of the V mode, and the V mode is better than the N mode. Therefore, it can be proved that the wearable stimulation device provided by the present invention can increase the activation of the deep muscles of the abdomen or waist.

Figure 12:
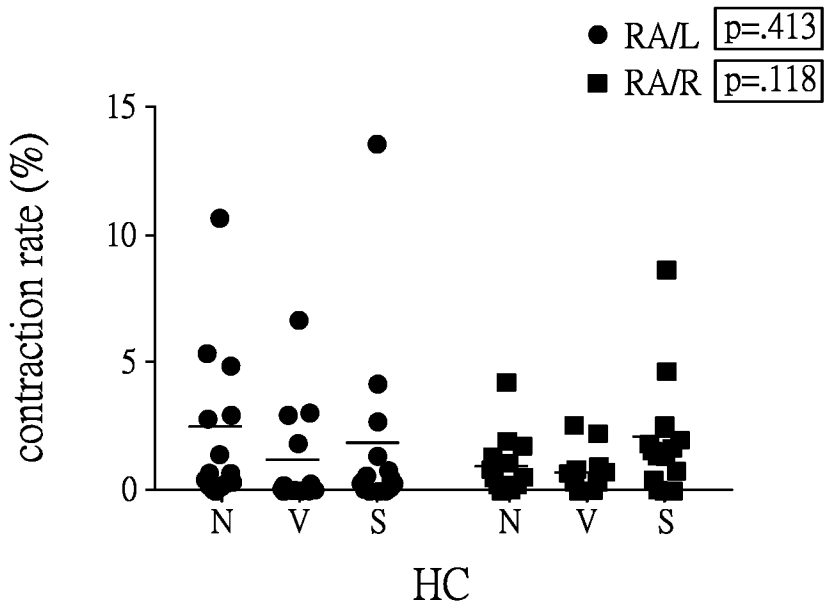
FIG. 12 is an electromyogram (EMG) of the average muscle activity value of the rectus abdominis (RA) according to the preferred embodiment of the present invention.
Figure 12:
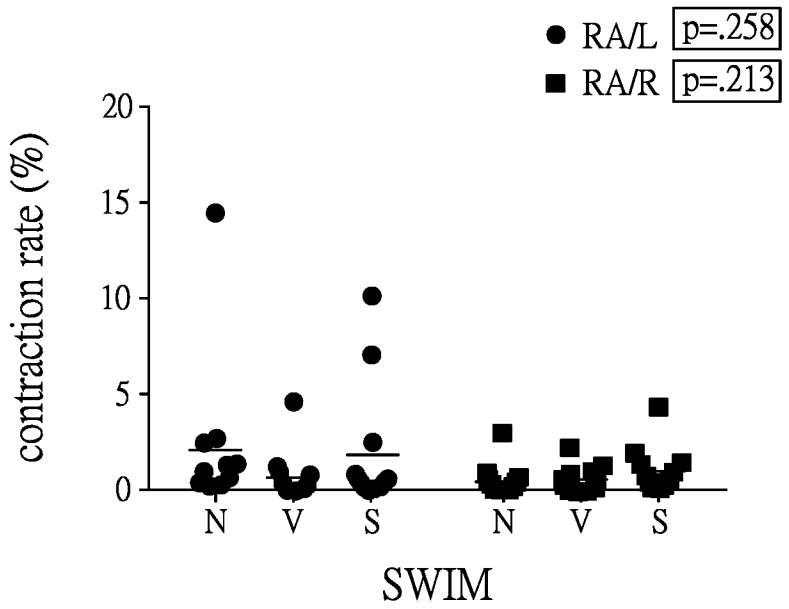

FIG. 12 is an electromyogram (EMG) of the average muscle activity value of the rectus abdominis (RA) of the superficial muscles after the SWIM group (solid line) and the HC group (dashed line) are tested in the three different test modes, N, V, and S, wherein the code of left muscle is L that is marked by dot, and the code of right muscle is R that is marked by square dot. A dot represents a person's data.

Figure 13:
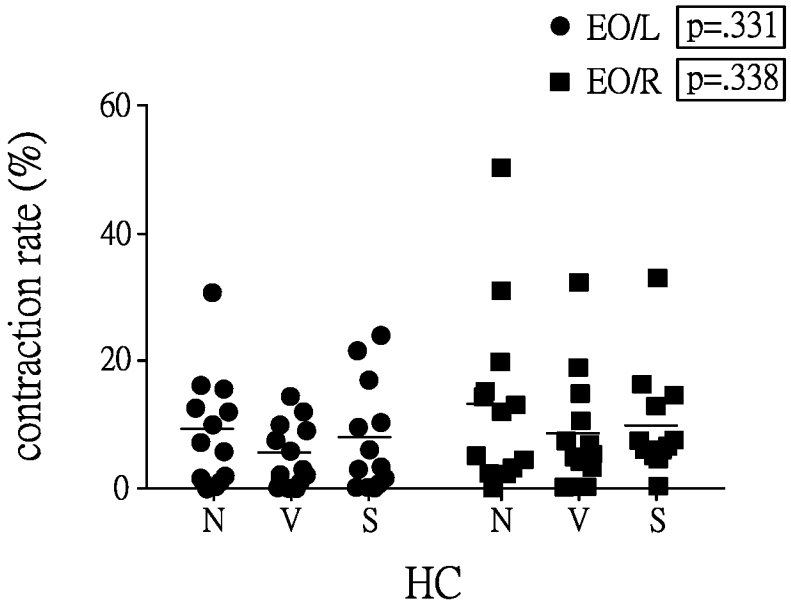
FIG. 13 is an electromyogram (EMG) of the average muscle activity value of the external oblique muscle (EO) according to the preferred embodiment of the present invention.
Figure 13:
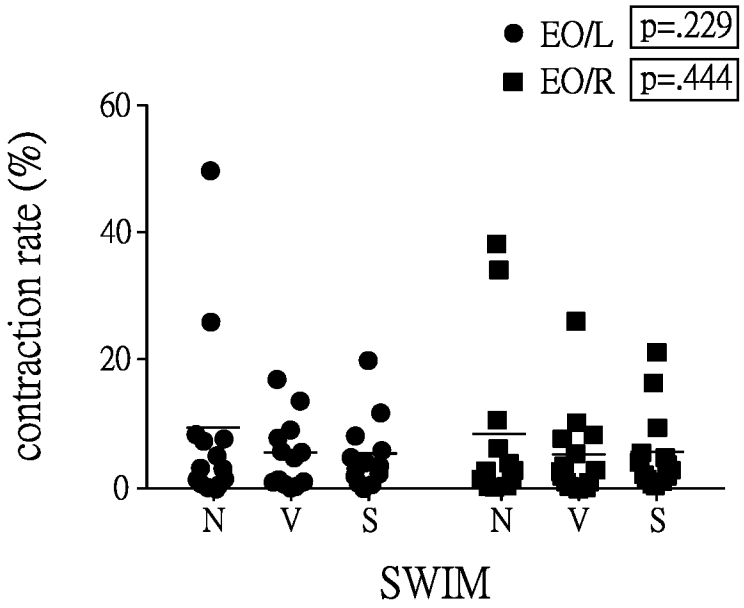

FIG. 13 is an electromyogram (EMG) of the average muscle activity value of the external oblique muscle (EO) of the superficial muscles after the SWIM group (solid line) and the HC group (dashed line) are tested in the three different test modes, N, V, and S.

Figure 14:
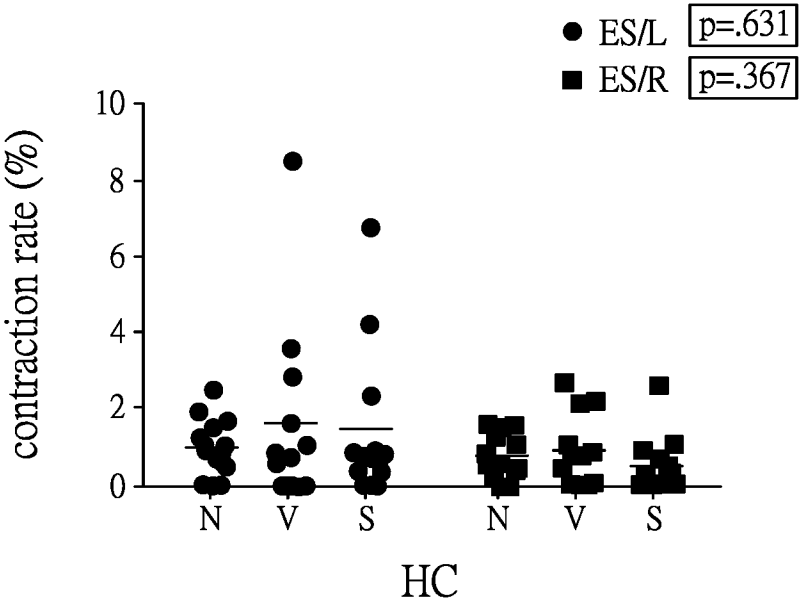
FIG. 14 is an electromyogram (EMG) of the average muscle activity value of the erector spinae (ES) according to the preferred embodiment of the present invention.
Figure 14:
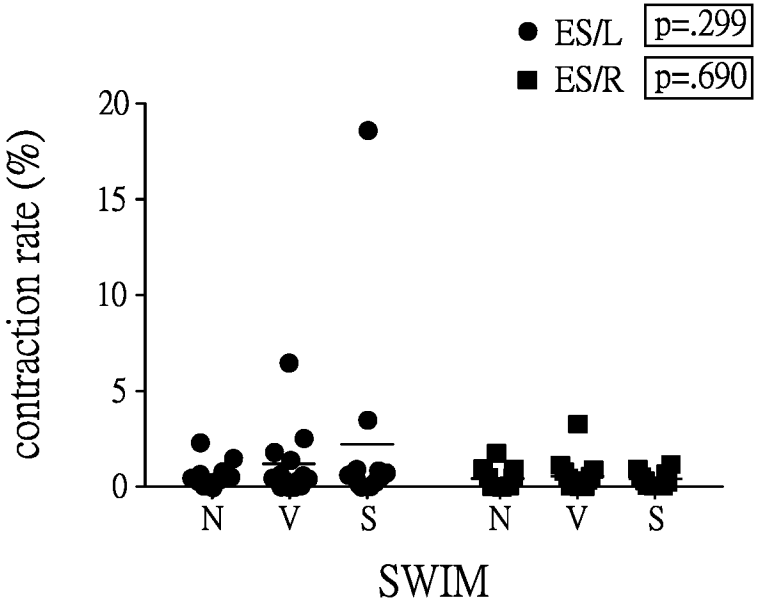

FIG. 14 is an electromyogram (EMG) of the average muscle activity value of the erector spinae (ES) of the superficial muscles after the SWIM group (solid line) and the HC group (dashed line) are tested in the three different test modes, N, V, and S.

As shown in FIG. 12, FIG. 13 and FIG. 14, it can be clearly seen that there is no significant difference in the amount of change in each superficial muscle. Therefore, it can be proved that the wearable stimulation device provided by the present invention does not have a particularly significant effect on the superficial muscles of the abdomen or waist.

It is proved by the above test results that the wearable stimulation device provided by the present invention can only stimulate the deep muscles of the abdomen or waist, such as the transverse abdominis (TrA) of the abdomen and the multifidus (MF) muscle of the waist, to increase the activation of the deep muscles. It does not affect the superficial muscles, and does not make the superficial muscles of the waist stimulation area stiff, such as the rectus abdominis (RA), the external oblique muscle (EO) and the erector spinae (ES). Therefore, the present invention can effectively act on the deep muscles in the stimulation area of the abdomen and waist of the human body, thereby strengthening the deep muscles of the abdomen and waist and increasing the motion control ability of the abdomen and waist. It can be used for the elderly, those with waist injuries or those who need rehabilitation.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A wearable stimulation device, comprising:

a wearable member;

at least one stimulation unit secured to the wearable member, the stimulation unit including an immovable end having a disc shape, a stimulation end having a disc shape, and a power element, the power element being connected between the immovable end and the stimulation end for driving the stimulation end to reciprocate relative to the immovable end, a periphery of the immovable end being provided with a plurality of immovable blocks, each of the immovable blocks is provided with a slide rail, a periphery of the stimulation end being provided with a plurality of movable blocks, and the movable blocks are insertedly disposed on the slide rails of the immovable blocks to slide on the slide rails;

at least one driver, being in signal connection with the power element, the driver being configured to output a vibration signal to the power element for the stimulation end to have a stroke of between 8.8 mm and 10.8 mm, a thrust of between 5.6 N and 7.6 N and a reciprocating frequency of between 180 Hz and 220 Hz; and a noise generator, being in signal connection with the driver, the noise generator being configured to output a noise signal, the noise signal being combined with the vibration signal to be simultaneously output to the power element to provide a combined vibration and noise mode for use in stimulating deep muscles of an abdomen or waist of a human body to increase activation of deep muscles, without an effect on superficial muscles of the abdomen or waist.

2. The wearable stimulation device as claimed in claim 1, wherein the noise generator has a noise control interface for outputting the noise signal, and the noise signal is a Gaussian signal.

3. The wearable stimulation device as claimed in claim 1, further comprising an optical scale unit, the optical scale unit including a detector and a scale, the detector being fixed to any one of the immovable blocks, the scale being fixed to a corresponding one of the movable blocks, the detector being configured to detect a displacement distance of the scale to obtain a movement distance of the stimulation end relative to the immovable end.

4. The wearable stimulation device as claimed in claim 1, wherein the stimulation end has an action surface, and at least one stimulation protrusion is provided on the action surface.

5. The wearable stimulation device as claimed in claim 1, wherein the power element is a voice coil motor, the voice coil motor includes a coil part and a magnet part, the coil part is fixed to the immovable end, the magnet part is fixed to the stimulation end, after the coil part is energized, a magnetic field is generated, and the magnet part interacts with the magnetic field so that the magnet part generates a reciprocating motion relative to the coil part.

6. The wearable stimulation device as claimed in claim 1, wherein the vibration signal is a sine wave signal.

7. The wearable stimulation device as claimed in claim 1, wherein the stroke of the stimulation end is 9.8 mm, the thrust of the stimulation end is 6.6 N, and the reciprocating frequency of the stimulation end is 200 Hz.

8. The wearable stimulation device as claimed in claim 1, wherein the wearable member is a waist belt configured to be worn around an abdomen or waist of a human body to position the stimulation unit.

* * * * *